US011648793B2

(12) United States Patent
Prehn

(10) Patent No.: US 11,648,793 B2
(45) Date of Patent: May 16, 2023

(54) METHOD FOR PRODUCING A DECORATIVE ELEMENT AND USE OF THE DECORATIVE ELEMENT

(71) Applicant: KOMMANDITGESELLSCHAFT SYNOPTRIX LICHTTECHNIK GMBH & CO., Hamburg (DE)

(72) Inventor: Horst Prehn, Gruenberg (DE)

(73) Assignee: KOMMANDITGESELLSCHAFT SYNOPTRIX LICHTTECHNIK GMBH & CO., Hamburg (DE)

( * ) Notice: Subject to any disclaimer, the term of this patent is extended or adjusted under 35 U.S.C. 154(b) by 33 days.

(21) Appl. No.: 17/273,756

(22) PCT Filed: Sep. 4, 2019

(86) PCT No.: PCT/EP2019/073615
§ 371 (c)(1),
(2) Date: Apr. 14, 2021

(87) PCT Pub. No.: WO2020/049061
PCT Pub. Date: Mar. 12, 2020

(65) Prior Publication Data

US 2021/0347196 A1 Nov. 11, 2021

(30) Foreign Application Priority Data

Sep. 6, 2018 (DE) ..... 10 2018 121 767.6

(51) Int. Cl.
*B42D 25/391* (2014.01)
*B42D 25/364* (2014.01)
(Continued)

(52) U.S. Cl.
CPC ..... *B42D 25/391* (2014.10); *B42D 25/364* (2014.10); *B44C 5/0407* (2013.01); *B44F 1/00* (2013.01)

(58) Field of Classification Search
CPC ..... B44C 5/0407
See application file for complete search history.

(56) References Cited

U.S. PATENT DOCUMENTS 8,500,901 B2 8/2013 Rueger et al.

FOREIGN PATENT DOCUMENTS

CN 106662798 A 5/2017
CN 107709035 A 2/2018
(Continued)

*Primary Examiner* — Nathan T Leong
(74) *Attorney, Agent, or Firm* — Dickinson Wright PLLC; Nicholas P. Coleman

(57) ABSTRACT

A method for producing a decorative element and uses of a decorative element. A polarizing layer functioning as an analyzer is applied to a transparent optical carrier material and a transparent optical functional layer is applied as an image-forming layer including an optically anisotropic material. By spatially structuring the functional layer, a targeted location-dependent dependency of material properties of the optically anisotropic material is created for producing the image-forming layer. One or several decorative elements produced can each be introduced into a light field of a lighting device in a desired shape, size and quantity and having settable image motifs (image structures) and being disposed at different spatial distances and being freely disposable. The decorative element produced is intended to be used as an architectural element for creating light-optical effects in the exterior area of buildings, as a design element for interior design or for object design.

14 Claims, 4 Drawing Sheets

(51) Int. Cl.
*B44C 5/04* (2006.01)
*B44F 1/00* (2006.01)

(56) References Cited

FOREIGN PATENT DOCUMENTS

| | | | | |
|---|---|---|---|---|
| DE | 1020070222264 | A1 | | 11/2008 |
| DE | 102008032224 | A1 | | 1/2010 |
| EP | 0727472 | A1 | | 8/1996 |
| EP | 1624030 | A2 | | 2/2006 |
| WO | 03054810 | A2 | | 7/2003 |
| WO | 2004099319 | A2 | | 11/2004 |
| WO | 2005078669 | A1 | | 8/2005 |
| WO | 2011057671 | A1 | | 5/2011 |
| WO | 2015150295 | A1 | | 10/2015 |
| WO | WO2015150295 | | * | 10/2015 |
| WO | 2016141420 | A1 | | 9/2016 |
| WO | WO2016141420 | | * | 9/2016 |

* cited by examiner

Fig. 1
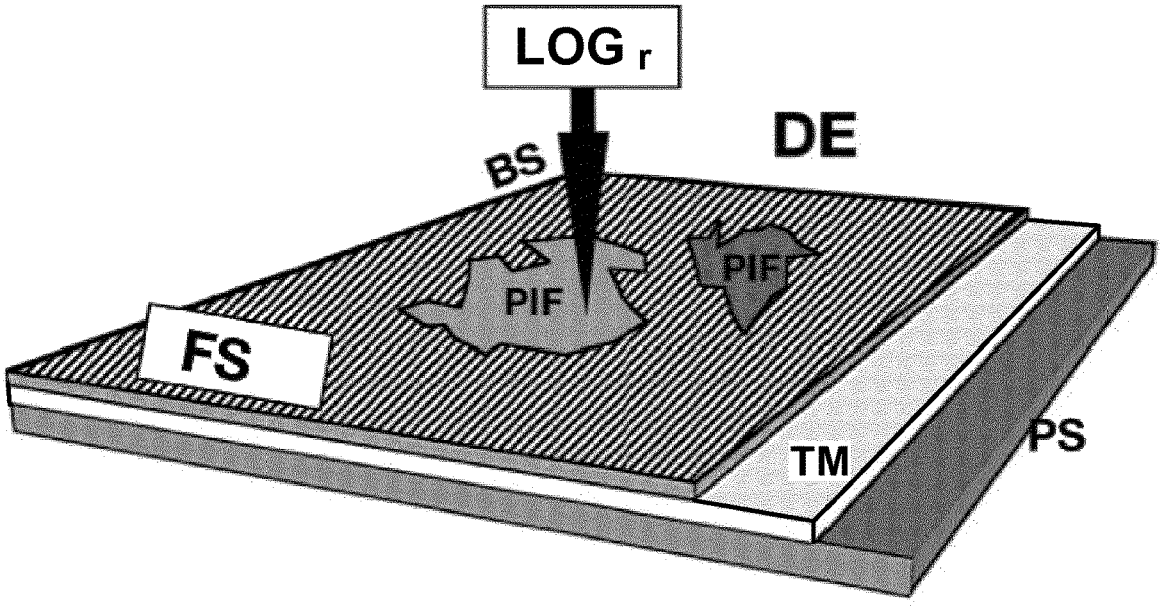
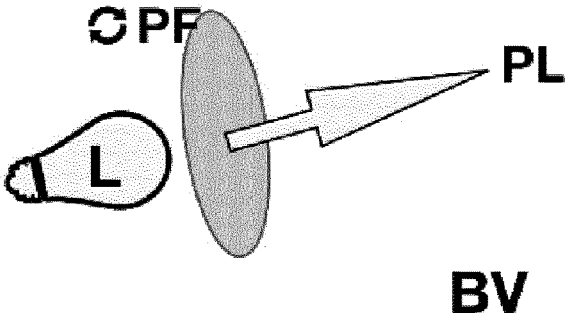
Fig. 2

Fig. 4
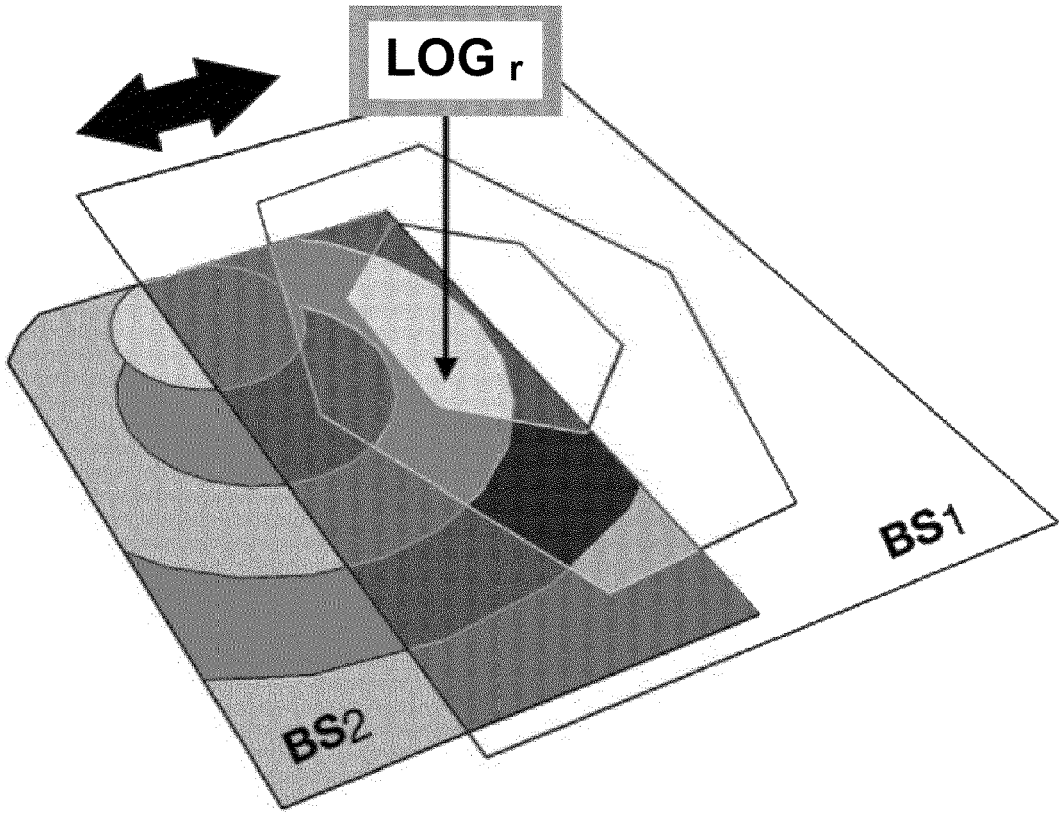
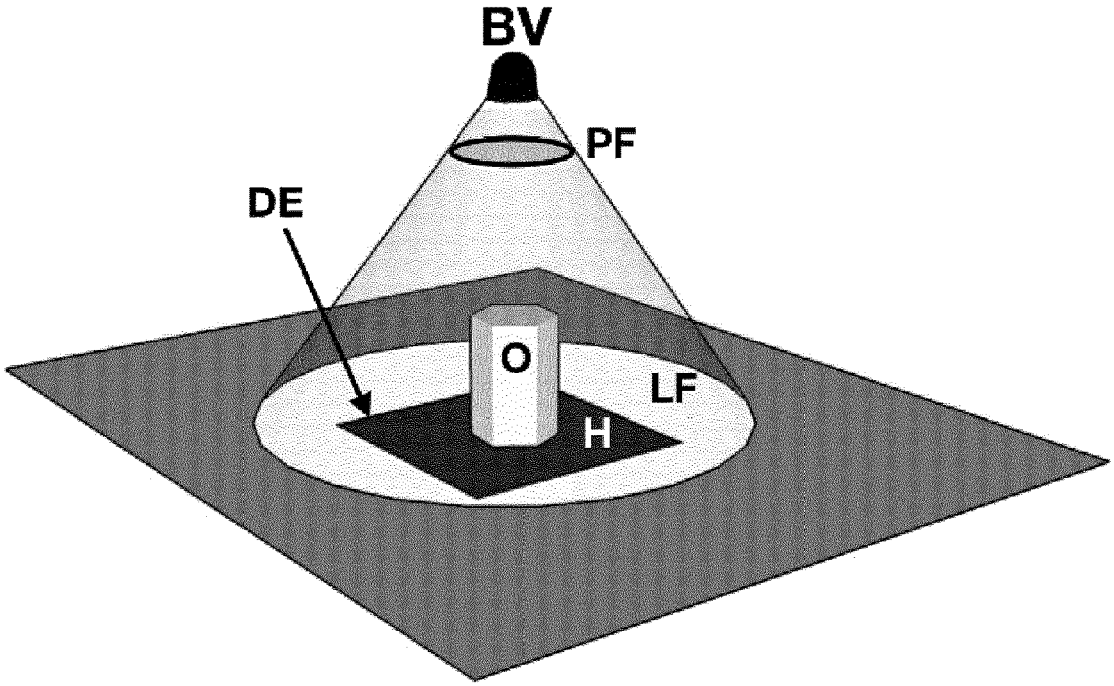
Fig. 5

Fig. 6
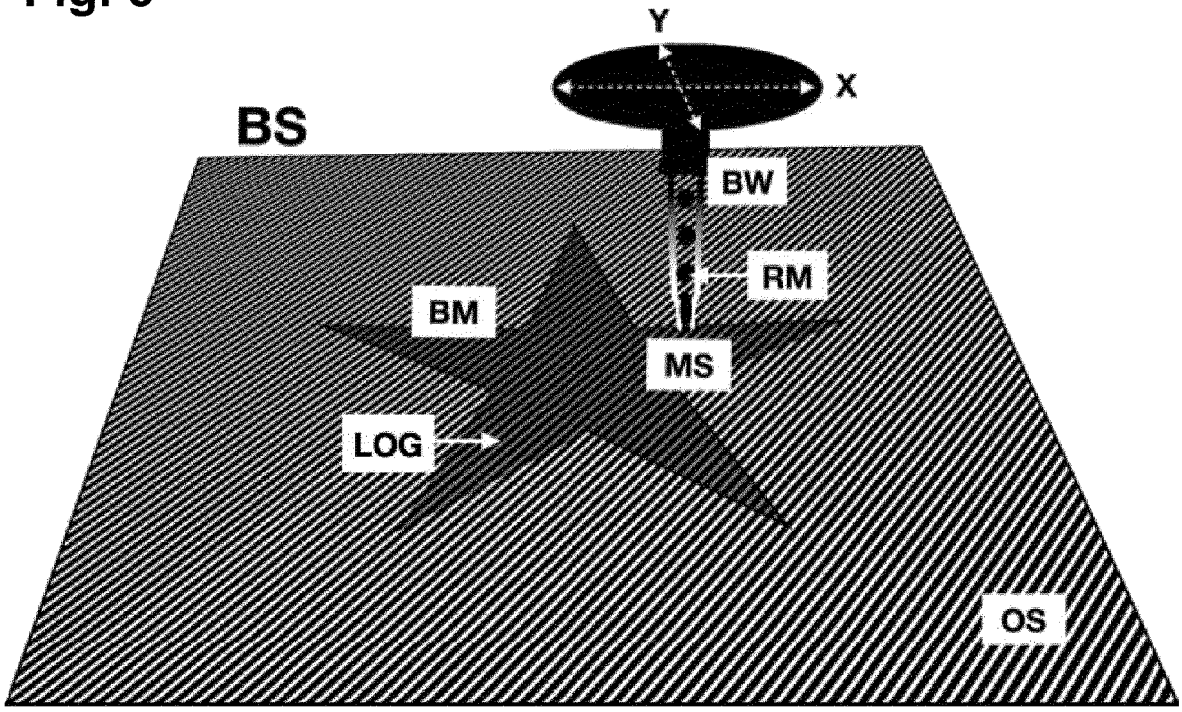
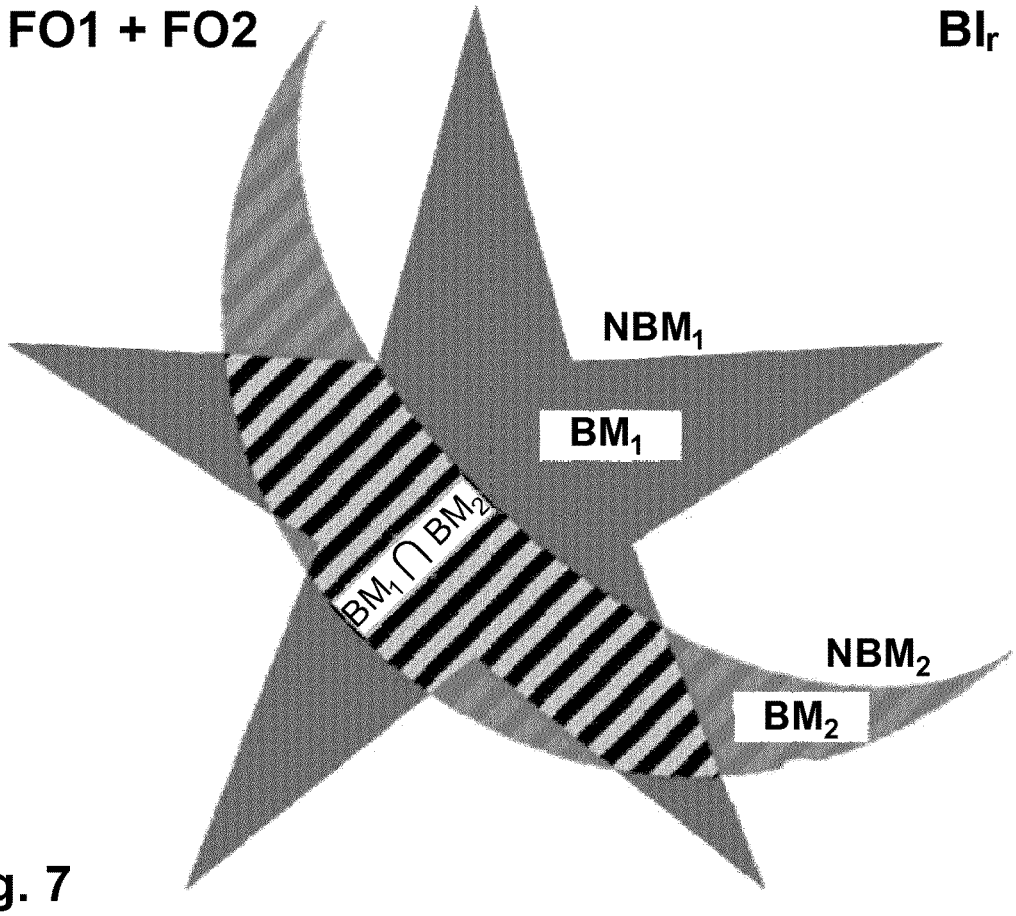
Fig. 7

METHOD FOR PRODUCING A DECORATIVE ELEMENT AND USE OF THE DECORATIVE ELEMENT

FIELD OF THE INVENTION

The invention relates to a method for producing a decorative element and uses of decorative elements produced in this way.

BACKGROUND OF THE INVENTION

Decorative elements are known which display a specific graphical, visual or textual design and which are of such a nature that specific colors, paints, substances or coatings, which are generally produced using specific substance-based color pigments (dyes), are generally used for designing the respective decorative surfaces.

Likewise, special pigments are known which have additional optical effects beyond the actual color values and by means of which in particular corresponding decorative elements can also be produced.

Decorative coatings are known which have specific optical effects, for example, at different viewing angles or regarding their reflection behavior. For the production and decorative design of corresponding decorative elements, numerous effect pigments are used, in particular specific interference pigments, multilayer pigments, metal effect pigments or goniochromatic pigments. These so-called gloss or effect pigments, which have specific interference phenomena, are thus used very versatilely, for example, for automotive paints, decorative coatings of all kinds and for coloring plastic, paint and ink.

EP 0 727 472 A1 describes an effect paint, in particular for motor vehicle bodies, in which the optical effect consists of a so-called color flop, whereby a changed color impression (goniochromatic pigment) appears depending on the light incidence.

EP 1 624 030 A2 shows metal effect pigments having a silvery and color-neutral pigment mixture which uses two different pigments, weakly colored silvery interference pigments and weakly colored interference pigments of complementary color.

EP 1 620 511 A2 describes an interference pigment having a high covering power, comprising a platelet-shaped inorganic substrate and having a layer containing $FeTiO_3$.

U.S. Pat. No. 8,500,901 B2 discloses interference pigments which are based on a flaky substrate and which consist of layers having a high or low refractive index.

The decorative elements mentioned are produced by means of specific known decorative colorings, paints or coatings. To this end, specific color pigments are used without exception, wherein the production of the respective coloring and the manufacture of the decor patterns is based on one specific substance base and the respective color of these pigments in each case.

In the particular case of effect pigments, by means of which specific additional optical effects can be produced on the decorative elements in addition to the respective color, these effects are essentially based on the known fundamental optical effects of the interference phenomena in thin layers. However, these effects, such as goniochromatic effects, only exhibit an appearance limited to a small number of effects, such as color flop effects.

All known decorative elements or decorative surfaces are disadvantageous in the sense that, on the one hand, the selected motif or decor including its optical image remains permanently visible and, on the other hand, the respective appearance is not instantaneously changeable in a targeted manner.

This disadvantage is ultimately based on the fact that known color pigments or specific substance-based color particles which are basically permanently visible are applied in the production method of the decorative elements.

Displays of optical effects in connection with a suitable lighting device are also known.

EP 2 499 538 B1 shows a system in which a lighting device having a dynamically controllable light-modulating function generates light-optical effects in combination with a displaying object as a projection surface.

However, such a system is a relatively complex installation because of the dynamic interaction between the light-modulating lighting device and the displaying object.

SUMMARY OF THE INVENTION

The object of the present invention is therefore to propose a method for producing a decorative element, wherein no substance-based color pigments are to be used and the decorative element to be produced is to serve to produce, display and vary a settable color-graphic motif in connection with a suitable lighting device.

This object is attained by a production method comprising the following steps: providing a transparent optical carrier material TM which has a planar or a curved surface and which consists of a glass substrate or a plastic substrate, applying a polarizing layer PS, which functions as an analyzer, to one side of the carrier material TM, applying a transparent optical functional layer FS as an image-forming layer BS, which consists of an optically anisotropic material OAM having a layer thickness, to the other side of the carrier material TM, structuring the functional layer FS in an image-forming spatial manner by means of a targeted location-dependent dependency of material properties of the optically anisotropic material OAM for producing the image-forming layer BS in the form of an image motif BM, such that settable color contrasts having defined polarization interference colors PIF according to the image motif BM are displayable on a lighted surface of the decorative element DE by lighting it with polarized light.

On a transparent optical carrier material TM consisting of a glass substrate or a plastic substrate having a planar or curved surface, a polarizing layer PS which functions as an analyzer is first applied to a lateral surface. On the other side, a transparent optical functional layer FS having a specific layer thickness is applied to the carrier material TM as an image-forming layer BS which consists of an optically anisotropic material OAM.

Advantageously, the decorative element DE can be formed into any shape, for example, a flat object having a planar or curved shape or a profiled surface element or a corporeal object.

By spatially structuring the functional layer FS in an image-forming manner, a targeted location-dependent dependency of material properties of the optically anisotropic material OAM is created in a next step for producing the image-forming layer BS in the form of an image motif BM.

Furthermore, the image-forming layer BS can contain, for example, patterns, fonts or motifs having a virtually unlimited number of hues and each having the desired color pallets and having different color saturation and color contrasts which can be used for the purpose of free design.

In this manner, an alternative method for the color design of the artistic or graphic surfaces of a decorative element DE is presented, during the production of which no substance-based color pigments are used, but instead, an uncomplicated and simple method is applied for producing a decorative element DE whose use in connection with a suitable lighting device BV allows multicolor color contrasts to be generated and designed on the decorative elements DE in a purely physical manner henceforth and wherein, according to the invention, specific transparent materials having a specific characteristic, structure and arrangement are used.

According to the method according to the invention, the decorative elements DE consist of appropriate passive materials in a specific arrangement, wherein the decorative elements DE in connection with being lighted according to the method then have a special new light-optical functionality and wherein only in this case, the respective color-graphic design of the otherwise latent motifs visibly appears, whereas no optical phenomena become visible when the decorative elements DE are lighted by natural or other common artificial light sources.

The optical functional layers FS consisting of passive materials and contained in the decorative elements DE are further characterized by special internal material characteristics defined according to the invention and having specific material properties in the form of a defined optical anisotropy, which additionally allows the settable latent image motifs BM to be imprinted because of the local variation or modification of this material property.

In addition, it is advantageous that the passive materials are inexpensively available and can easily be mass-produced, these materials being characterized by simplicity, sturdiness and the applicability of common processing and assembly technologies, such that they can be conveniently produced using a plurality of materials, shapes, profiles having various surface characteristics and compositions.

In a further embodiment, a transmissive polarizing layer PSt is used as a polarizing layer PS for producing an illuminated decorative element DE or a reflexive polarizing layer PSr is used as a polarizing layer PS for producing a reflecting decorative element DE.

The transmissive decorative elements DE which have the transmissive polarizing layer PSt on the side of the observer can thus advantageously be used in transparent window elements, for example, wherein they can each have a specific arrangement, which can also comprise a corresponding backlighting.

On the other hand, reflexive decorative elements DE, which consequently have the reflexive polarizing layer PSr, can advantageously be used for all non-transparent architectural or design elements (see below), said reflexive polarizing layer PSr being disposed behind the image-forming layer BS and thus the light impinging on the decorative element DE being reflected in the direction of the observer.

Advantageously, the targeted location-dependent dependency of the material properties of the optically anisotropic material OAM is effected by one or several of the following local changes: a) varying the optical anisotropy, b) varying the layer thickness, c) varying a local alignment.

The spatial structuring of the optically anisotropic material OAM and thus the production of the image motif BM by means of a location-dependent change in the material properties can thus be effected by influencing the optical anisotropy, the layer thickness or the local alignment.

Furthermore, a local optical path difference LOG settable in a defined manner is realized by the targeted location-dependent dependency of the material properties of the optically anisotropic material OAM, wherein each value of the local optical path difference LOG corresponds to one defined polarization interference color PIF, which imprints the image motif BM.

This imprinting of the respective image information is based on the use and targeted modification of a specific material characteristic of the functional layer FS for producing the image-forming layer BS, wherein in particular optically anisotropic materials OAM having a specific locally defined optical anisotropy are used and whereby the image motifs BM are produced in the sense of a so-called phase image and wherein this image information is based on the accordingly addressed local optical path differences LOG in the sense of the image motif BM and whereby corresponding localized color contrasts can be produced according to the polarization interference colors PIF resulting from the values of the local optical path difference LOG.

The color values to be expected based on the respective values of the local optical path difference LOG are illustrated by the Levy interference color chart, for example, wherein the allocation between the respective value of the optical anisotropy or the local optical path difference LOG and the respective colors is shown.

This correlation can be advantageous for the design of the image motifs BM because the Levy color chart allows pre-determining the required local optical path differences LOG for producing the desired color pallet and can thus be used for individually designing the respective color contrasts.

The targeted locally addressable imprinting of specific local optical path differences LOG in the sense of a settable image motif BM on an image-forming layer BS can be caused by different means and methods.

For example, specific transparent plastic materials (such as polycarbonate) or specific axially stretched film materials (such as BOPP) or corresponding materials which are based on liquid crystals (such as reactive mesogens RM) can be used in the sense of the method according to the invention.

Advantageously, the local optical path difference LOG is realized in such a manner over the whole surface or a defined part of the surface of the decorative element DE that it has a specific settable constant value.

Preferably, the local optical path difference LOG is realized in such a uniform manner for a defined part of the surface of the decorative element DE that the settable constant value is near zero, which causes the respective polarization interference color PIF to be generated achromatically for the uniform surface of the decorative element DE.

The decorative element DE thus appears having only one specific uniform brightness, wherein the degree of the respective brightness depends on the relative alignment of the orientation in the polarizing layer PS in relation to the polarization direction of the lighting, and whereby the maximally brightened local areas produce the color impression white when the relative polarization direction is varied accordingly, whereas in the case of accordingly dimmed local areas, the respective gray values up to black are perceived.

Furthermore, to form the functional layer FS, an alignment layer OS is first applied to the carrier material TM and an LC material LC based on liquid crystals is applied on top as an optically anisotropic material OAM.

In connection with the production and the color-graphic design of the image-forming layer BS, materials are preferably used which are based on liquid crystals and have a specific optical anisotropy themselves, wherein means are used in order to cause a structuring of the local optical anisotropy and/or the layer thickness and/or the alignment addressable in a targeted manner, whereby the respective values of the local optical path difference LOG can be imprinted in a specific settable graphic shape according to the settable image motifs BM.

For producing the LC layer LC, for example, reactive mesogens RM can be used, by means of which accordingly graphically structured image-forming layers BS can be produced having local optical path differences LOG addressable in a targeted manner.

By means of different methods, an alignment layer which defines the respective optical axis and is generally applied to a transparent carrier material TM is generally first realized, whereby the optical axis of the reactive mesogens RM applied subsequently according to a desired structuring is also defined and whereupon the respective mesogenic layer is also accordingly oriented and subsequently cured (for example, UV curing).

In a first step, for example, an accordingly structured alignment layer OS is first produced on a suitable transparent carrier material TM, for which different available orienting methods (for example, photoalignment by means of specific photolithography methods using corresponding masks) can be used and wherein the respective optical axis of each selected anisotropic domain can be aligned in a targeted manner. This alignment which is settable in a corresponding domain is then transferred to an LC layer LC, which is coated in a subsequent step, in the form of a mesogenic layer, for example.

The image-forming layers BS can then also be applied in several layer sequences by means of the alignment layer in connection with the respective LC layers LC in the form of reactive mesogens RM according to the settable graphic structure and by means of different methods, whereby the values required for producing the image-forming layer BS for the local optical path difference LOG each resulting from the respective layer structure can be produced, which then represent the latent image motifs BM.

Preferably, the LC material LC is applied by means of coating methods followed by curing methods or by means of printing techniques.

Exemplary technologies include slot-die coating or Mayer rod coating.

As an alternative to applying an LC material LC, a film material FO can be applied as an optically anisotropic material OAM to form the functional layer FS.

For producing the image-forming layer BS, film materials FO are used which are commercially available in the form of correspondingly customized plastic films (for example Oracal films of the company Orafol or axially stretched films such as BOPP) and which can be used for producing and designing the image-forming layer BS according to the invention because they already have a specific internal optical anisotropy which, in this case, can be utilized for the graphic image design and/or also be specifically modified by means of a corresponding targeted follow-up treatment, whereby the graphically structured local optical path differences LOG desired in each case can be achieved.

The film material FO is preferably applied by means of laminating.

By means of a laminating process, the film material FO can be connected to the carrier material TM in a simple manner.

Advantageously, a targeted spatially-structured birefringence is induced in the film material FO by means of appropriate treatment measures or an existing intrinsic optical anisotropy of the film material FO is exploited and/or provided with follow-up treatment in a targeted manner for producing the image motif BM.

A suitable follow-up treatment can be a controlled locally addressable change in the optical anisotropy values in the respective film material FO, for example. Also conceivable is the complete elimination of the anisotropy and the conversion of corresponding image areas into correspondingly arranged isotropic domains which subsequently form a corresponding contrast to the image areas still having a corresponding anisotropy, whereby a graphic structure according to the image correspondingly stands out from its background.

Also advantageous is the very simple follow-up treatment of the film material FO aiming to subsequently cause a targeted location-specific elimination of the intrinsic optical anisotropy present in the respective film material FO, whereby respective contrasts in the sense of production and graphic design of the motifs can be produced and wherein the respective negative image motif NBM is cut from the film material FO, which itself has specific values of the local optical path difference LOG, meaning the local optical anisotropy, which are relevant for the respective image motif BM, and wherein appropriate tools, such as cutting plotters, laser cutters or water jet cutters, can be utilized.

Advantageously, a plurality of transparent optical functional layers FSi are applied as image-forming layers BSi which have different image motifs BMi and which are superimposed on each other in a defined manner, forming a composite, and which are joined as in a resulting interacting optical functional layer FSr, producing a resulting effective local optical path difference LOGr for the composite.

When joined in a composite, the respective different image-forming layers BSi can each have a correspondingly different and settable layer thickness, alignment, orientation and arrangement in a specific layer sequence, resulting in a respective effective local optical path difference LOGr for the resulting optical functional layer FSr which is joined in a composite in this manner.

In this manner, very complex multiform and correspondingly multicolor color-graphic image motifs BM including a correspondingly extended color pallet and a corresponding number of different color contrasts of the polarization interference colors PIF can be produced, whereby the corresponding image motif BM with its color compositions can be designed accordingly.

A specific change in the alignment, for example, in sections of the image-forming layer BS, offers an additional design option for the respective color values, which can be utilized in particular when using optically anisotropic foil materials FO and which is particularly advantageous when several stacked films (see below) are to be used, wherein an additional design option for the resulting color values is made possible by means of an additional change in the respective alignment in sections or in the respective layers.

Advantageously, a plurality of film layers FOi can be applied to the carrier material TM as a stack when the optically anisotropic material OAM is realized as film material FO.

Such an arrangement of multiple film layers FOi superimposed on each other in a specific manner in a decorative element DE stacked accordingly, wherein each of the individual film layers FOI has a specific image-forming layer Bsi, which contains an image motif BMi in this respect, and wherein these film layers FOi can be disposed in a specific manner such that the different optical local path differences LOGi each contained in a film layer FOi specifically overlap in defined partial surfaces with another film layer FOi or with several film layers FOi simultaneously, which results in a thus defined value for the thus resulting effective local optical path difference LOGr, which is then composed of the respective location-specific superpositions and which then bears a comprehensive resulting image motif BMr.

An additional means for the graphic design of the image motifs BMi can be the respective alignment of the respective film layers FOi, wherein the film layers FOi are each used in a desired arrangement and overlap and wherein the respective anisotropic film layers FOi each have an existing alignment with a specific preferred direction. In this context, an orientation rotated by a corresponding angle is arranged for the respective film layer FOi or for specific sections of the film layer FOi, whereby the respective local optical path differences LOGi and thus the resulting color contrasts of the respective polarization interference colors PIFi can be changed in a targeted and regulated manner according to their respective orientation relative to each other. Exemplarily, the retardance values typically increase when aligned, whereas, when rotated by 90°, the retardance values decrease accordingly.

Furthermore, the individual film layers FOi can extend over specific defined local areas each having different defined recesses and/or cutouts which are settable based on the respective motif.

Thus, the different film layers FOi partly overlap each other diversely, wherein several different layers of diverse image-forming layers BSi are realized by means of said film layers FOi, which can be used as a composite and with a respective settable film thickness, alignment, orientation and arrangement each.

The shared effective local optical path difference LOGr results from the interaction and the superposition of the individual local optical path differences LOGi.

Furthermore, the object of the invention is attained by the use of the decorative element produced according to the invention in a method in which light-optical effects are produced and influenced in a targeted manner solely via the light path in interaction with an external lighting device BV, which emits unpolarized or polarized light having a variable polarization direction, wherein the following operating modes are realizable: a) a neutral mode NM, wherein the decorative element DE does not have polarization interference colors PIF when lighted by unpolarized light and thus the latent color-graphic motifs FM in the image-forming layer BS remain invisible as a matter of principle, b) a presence mode PM, wherein the decorative element DE is lighted with polarized light and the color-graphic motifs FM are visibly displayed according to the defined polarization interference colors PIF, c) a color variation mode FVM, wherein a defined and stepless color variation is enabled in the color variation mode FVM by the defined polarization interference colors PIF within a color-graphic motif FM and the color variation in the decorative element DE is effected by means of a variation of the polarization direction of the polarized light.

One or several decorative elements DE produced according to the invention can each be introduced into a light field of a lighting device BV in a desired shape, size and quantity and each having settable image motifs BM (image structures) and being disposed at different spatial distances and being freely disposable.

The lighting device BV additionally allows a change between unpolarized or polarized light and the targeted variation of the polarization direction, wherein an isotropic light field which corresponds to the lighting conditions and which, in contrast, does not display any image structures (neutral mode NM) appears in the case of the unpolarized light. When the decorative element DE is lighted with polarized light, the latent image structures contained in the image-forming layer BS become visible as corresponding graphic image motifs BM in corresponding color contrasts (presence mode PM).

Additionally, the respective polarization and interference colors PF contained in the respective image motif BM can be varied (color variation mode FVM) in the same sense by means of the variation of the polarization direction.

The environment of the decorative elements DE or specific objects or items which are also lighted by the polarized light appear completely unchanged.

The special feature of the lighting with polarized light according to the invention is that the polarization displays very specific light characteristics which are not perceivable with the naked eye and thus a difference between polarized and unpolarized light is not noticeable.

For this reason, the light quality and brightness observed by the naked eye remains unchanged in all cases when switching between unpolarized and polarized light and also when varying the polarization direction and thus does not differ from ordinary lighting by lamplight.

Apart from the above-mentioned special light characteristics on the part of the lighting, the light-optical functionality is also based on the additional special feature of the material property of the image-forming layer used in this case in the decorative elements DE, which is that structures are also not visible within this material because of a completely transparent material property and in the case of the optical anisotropy in ordinary lighting conditions, which generally do not have polarized light, wherein optically anisotropic materials also appear continuously transparent and the accordingly structured polarization interference colors PIF only become visible when lighted with polarized light.

The spatial separation between the lighting device BV and the freely arrangeable decorative element DE is advantageous in that, depending on the embodiment and arrangement, the decorative element DE can be used in transmitted light in the transmissive case or in reflective light in the reflective case.

Furthermore, it is advantageous that the decorative element DE produced according to the invention, meaning each decorative element DE itself, comprises a specific latent image motif BM and that, in this case, it is present in the form of a specific optical material characteristic and having a real material inner spatial structure. Thus, the arrangement of any number of decorative elements DE, which are all lighted by a respective light source, thus fundamentally differs from common image projection.

This is because each decorative element DE formed and dimensioned individually different can be jointly lighted by a single light source (lighting device BV) together with a specified number of additional decorative elements DE in a desired spatial arrangement and each having a different spatial depth, wherein the respective decorative elements DE can each bear separate different image motifs BMi and all decorative elements DE can be moved arbitrarily in their respective spatial arrangement.

In contrast, a conventional image projection always requires specific imaging optics and a corresponding screen, on which each single image projected from only one projector can be depicted sharply on only one single image plane which has a set spatial depth and wherein the respective image from a projection can be focused only with regard to a single defined distance from the screen.

Furthermore, it is advantageous that the decorative elements DE solely consist of passive materials and thus comprise neither moveable parts nor electronic elements nor require any power supply from electric lines.

Nevertheless, an actively controllable variation of the respective optical appearance can be effected in an invisible manner and solely via the light path in these passive decorative elements DE, whereby specific operating modes, for example, can be selected freely on the part of the lighting, such as the visibility of the image motif BM in the case of the presence mode PM or its invisibility in the case of the neutral mode NM and the variation of the color contrasts in the case of the color variation mode FVM.

Selecting and executing the operating modes neutral mode NM, presence mode PM and color variation mode FVM in the lighting device BV is effected by adjusting means M which are realized by means of a polarization filter PF and its respective position in the optical path of the lighting.

Preferably, selecting and executing a specific operating mode by means of the adjusting means M is effected a) for the neutral mode NM by means of removing the polarization filter PF from the optical path, b) for the presence mode PM by means of introducing the polarization filter PF into the optical path and c) for the color variation mode FVM by suitably rotating the polarization filter PF, wherein switching at will arbitrarily between the disappearance in the neutral mode NM, the visibility in the presence mode PM and the color variation in the color variation mode FVM is possible.

Furthermore, in terms of a device, the decorative element produced according to the invention is intended to be used as an architectural element for creating light-optical effects in the exterior area of buildings, as a design element for interior design or for object design.

For example, a use as part of facades, wall coverings, ceiling elements, floor coverings or as part of diverse design objects, such as furniture, lamps or furnishing objects in general, seems possible.

In particular an embodiment of the decorative element DE as a sign-carrying element is advantageous.

The decorative element DE produced according to the invention can be used as a sign-carrying element, such as for optical guidance systems or as an image-carrying and text-carrying element for advertising spaces.

Furthermore, a use of the decorative element DE is advantageous in cases where mechanical processing, cutting or suitable customization of the decorative element, which consists of purely passive materials, is to be realized using common tools.

In terms of a device, a further use of the decorative element DE which is produced according to the invention and has the reflexive polarizing layer PSr and the local optical path difference LOG having the settable constant value near zero is that the decorative element DE is disposed as a background surface H on which an object O to be displayed is presented and wherein the object O and the background surface H are jointly lighted by a lighting device BV, such that when the luminosity in a light field LF which comprises both the object O and the background H is unchanged, solely the brightness of the background surface H is steplessly dimmable while the brightness of the jointly lighted object object O, which is also lighted, remains unchanged by varying a polarization direction of the lighting device BV.

BRIEF DESCRIPTION OF THE DRAWING FIGURES

Further advantageous features can be derived from the following description and the drawings, which explain a preferred embodiment of the invention using examples. In the figures:

FIG. 1: shows a schematic structure of a decorative element DE produced according to the invention, FIG. 2: shows a schematic arrangement of a lighting device BV, FIG. 3: shows a schematic view of an image-forming layer BS and a triple superposition of three image-forming layers BS1, BS2, BS3 offset at an angle, FIG. 4: shows a schematic view of two image-forming layers BSi partly overlapping, FIG. 5: shows an example of use with an object O which is located on the decorative element DE, FIG. 6: shows a schematic view of a production method of a decorative element DE based on an LC material LC and FIG. 7: shows an example of use of a decorative element DE having two film layers FOi.

DETAILED DESCRIPTION OF THE INVENTION

FIG. 1 shows a schematic design of a decorative element DE having an image-forming layer BS, a carrier layer TM, a polarizing layer PS and a functional layer FS, wherein the image-forming layer BS is present in the form of a local optical path difference LOG, whereby the respective polarization interference colors PIF appear according to the image motif BM.

FIG. 2 shows a schematic arrangement of a lighting device BV consisting of a light source L and a polarization filter PF which is variable with regard to the polarization direction, wherein the lighting device BV emits polarized light PL.

FIG. 4 shows a schematic view of two image-forming layers BS1 and BS2 each having a different image motif contained therein in partial overlap and superposition, wherein the corresponding resulting effective local path differences LOGr arise as a result of the superposition.

Figure 3:
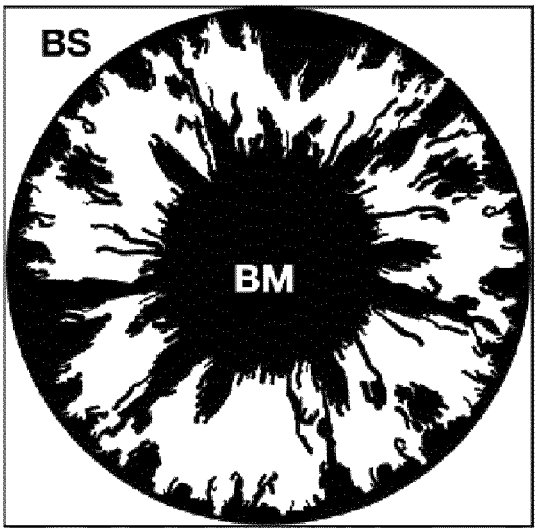
FIG. 3 shows a schematic view of an image-forming layer BS which constitutes an image motif BM and a superposition of three identical image-forming layers BS1, BS2, BS3 which have the same image motif BM and wherein the image-forming layers BS1, BS2, BS3 are each offset against each other at a specific angle and are accordingly disposed stacked on top of each other.
Figure 3:
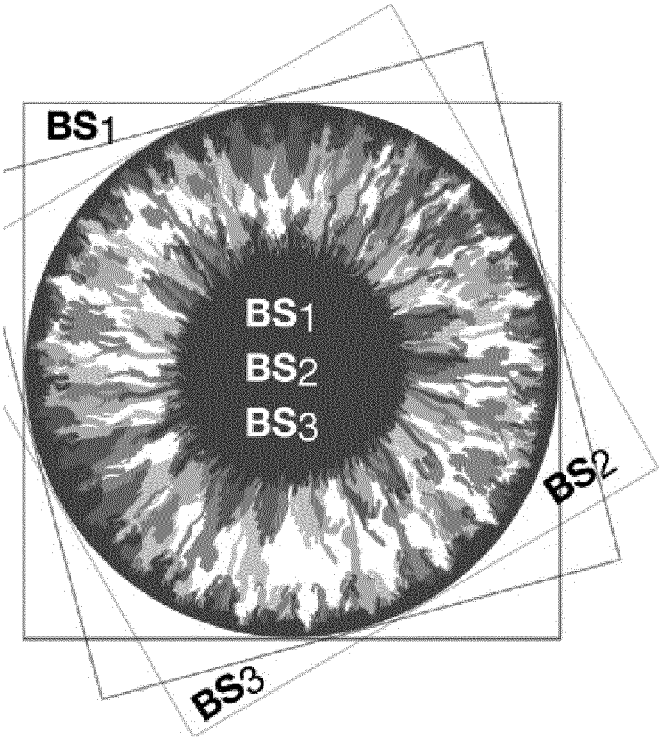

FIG. 5 shows a schematic view for an example of use, wherein the brightness contrast between a background H and a random object O which is located on a decorative element DE is changeable and wherein the brightness of the background H, which is located in the midst of the light field LF originating from the lighting device BV, is variable by means of the polarization filter PF in the lighting device BV.

FIG. 6 shows a schematic view for a production method for producing an image-forming layer BS (of a decorative element DE) using liquid crystal materials LC, in particular for applying a mesogenic layer MS, which produces the respective image motif BM according to a correspondingly (locally) addressable local optical path difference LOG.

A reactive mesogen RM in a corresponding spatial distribution according to the local coordinates x, y is applied to a correspondingly oriented alignment layer OS according to an image-forming structuring (image motif BM) by means of a device which has a corresponding coating tool BW.

FIG. 7 shows a schematic view for an example of use, wherein specific optically anisotropic film layers FOi (film materials) are used in the form of a stacked arrangement and with a corresponding partial overlap in order to design a specific and thus resulting image information BIr, wherein two film layers F01, F02 are shown here in an exemplary manner which have the different image motifs BM1, BM2 and wherein these image motifs BM1, BM2 are each in contrast to their surroundings, to which end the local areas NBM1, NBM2 surrounding each of the image motifs BM1, BM2 must correspondingly stand out or can simply be cut from the respective film.

The invention claimed is:

1. A method for producing a decorative element (DE), the method comprising the following steps:

providing a transparent optical carrier material (TM) which has a planar or a curved surface and comprising a glass substrate or a plastic substrate, applying a polarizing layer (PS), which functions as an analyzer, to one side of the carrier material (TM), applying a transparent optical functional layer (FS) as an image-forming layer (BS), which comprises an optically anisotropic material (OAM) having a layer thickness, to the other side of the carrier material (TM), structuring the functional layer (FS) in an image-forming spatial manner by means of a targeted dependency of location-dependent material properties of the optically anisotropic material (OAM) for producing the image-forming layer (BS) in the form of an image motif (BM), such that settable color contrasts having defined polarization interference colors (PIF) according to the image motif (BM) are displayable on a lighted surface of the decorative element (DE) by lighting it with polarized light.

2. The method according to claim 1, wherein a transmissive polarizing layer (PSt) is used as a polarizing layer (PS) for producing an illuminated decorative element (DE) or that a reflexive polarizing layer (PSr) is used as a polarizing layer (PS) for producing a reflecting decorative element (DE).

3. The method according to claim 1, wherein the targeted location-dependent dependency of the material properties of the optically anisotropic material (OAM) is effected by one or several of the following local changes:

a) varying the optical anisotropy, b) varying the layer thickness, c) varying a local alignment.

4. The method according to claim 1, wherein a local optical path difference (LOG) settable in a defined manner is realized by the targeted location-dependent dependency of the material properties of the optically anisotropic material (OAM), wherein each value of the local optical path difference (LOG) corresponds to one defined polarization interference color (PIF), which determines the image motif (BM).

5. The method according to claim 4, wherein the local optical path difference (LOG) is realized in such a manner over the whole surface or a defined part of the surface of the decorative element (DE) that it has a specific settable constant value.

6. The method according to claim 5, wherein the local optical path difference (LOG) is realized in such a uniform manner for the defined part of the surface of the decorative element (DE) that the settable constant value is near zero, which causes the respective polarization interference color (PIF) to be generated achromatically for the uniform surface of the decorative element (DE).

7. The method according to claim 1, wherein to form the functional layer (FS), an alignment layer (OS) is first applied to the carrier material (TM) and an LC material (LC) based on liquid crystals is applied on top as an optically anisotropic material (OAM).

8. The method according to claim 7, wherein the LC material (LC) is applied by means of coating methods followed by curing methods or by means of printing techniques.

9. The method according to claim 1, wherein to form the functional layer (FS), a film material (FO) is applied as an optically anisotropic material (OAM).

10. The method according to claim 9, wherein the film material (FO) is applied by means of laminating.

11. The method according to claim 9, wherein a targeted spatially-structured birefringence is induced in the film material (FO) by means of appropriate treatment measures or that an existing intrinsic optical anisotropy of the film material (FO) is exploited and/or provided with follow-up treatment in a targeted manner for producing the image motif.

12. The method according to claim 1, wherein a plurality of transparent optical functional layers (F Si) are applied as image-forming layers (B Si) which have different image motifs (B Mi) and which are superimposed on each other in a defined manner, forming a composite (V), and which are joined in a resulting interacting optical functional layer (FSr), producing a resulting effective local optical path difference (LOGr) for the composite (V).

13. The method according to claim 12, wherein, if the optically anisotropic material (OAM) is realized as film material (FO), a plurality of film layers (FOi) is applied to the carrier material (TM) as a stack.

14. The method according to claim 13 wherein the individual film layers (FOi) extend over specific defined local areas, each having different defined recesses and/or cutouts which are settable based on the respective motif.

* * * * *